US007458477B2

(12) United States Patent
Jones

(10) Patent No.: US 7,458,477 B2
(45) Date of Patent: Dec. 2, 2008

(54) AUTOMATIC CENTRAL BUFFER FOR A MULTI-MEMBER RAIL VEHICLE

(75) Inventor: Antony Jones, Shavington (GB)

(73) Assignee: Voith Turbo Scharfenberg GmbH & Co. KG, Salzgitter - Watenstedt (DE)

( * ) Notice: Subject to any disclaimer, the term of this patent is extended or adjusted under 35 U.S.C. 154(b) by 439 days.

(21) Appl. No.: 11/143,569

(22) Filed: Jun. 3, 2005

(65) Prior Publication Data

US 2005/0282422 A1 Dec. 22, 2005

(30) Foreign Application Priority Data

Jun. 4, 2004 (EP) ..... 04013265

(51) Int. Cl.
*B61G 1/06* (2006.01)

(52) U.S. Cl. ..... 213/1.3; 105/3; 439/135

(58) Field of Classification Search ..... 213/1.3, 213/1.6, 76; 105/3; 493/135, 138, 139
See application file for complete search history.

(56) References Cited

U.S. PATENT DOCUMENTS 3,387,714 A 6/1968 Dawson
3,633,762 A 1/1972 Gnavi et al.
6,474,488 B1 * 11/2002 Sullivan ..... 213/1.3

FOREIGN PATENT DOCUMENTS

CH 425 877 12/1966
WO WO 0074994 12/2000

* cited by examiner

*Primary Examiner*—S. Joseph Morano
*Assistant Examiner*—Robert J McCarry, Jr.
(74) *Attorney, Agent, or Firm*—Jean C. Edwards, Esq.; Akerman Senterfitt

(57) ABSTRACT

The present invention relates to an automatic central buffer coupling, especially of the "Tlghtlock/AAR" type of construction. The coupling includes a coupling head, with a supporting unit underneath; a hydraulic and/or compressed air terminal for a hydraulic or compressed air line; and an electrical contact carrier arranged underneath the supporting unit and having electrical contact terminals; and an actuating device to longitudinally displace the electrical contact carrier via the air line. The electrical contact carrier is in an uncoupled position rearward of the coupling plane of the central buffer coupling, and is displaceable into a coupling-ready forward position in the coupling plane via the actuating device. In order to ensure that the electrical contact carrier is automatically co-coupled after the mechanical coupling operation, a release mechanism is configured to ensure a coupling mechanism is triggered to co-couple the at least one hydraulic and/or compressed air terminal.

7 Claims, 3 Drawing Sheets

AUTOMATIC CENTRAL BUFFER FOR A MULTI-MEMBER RAIL VEHICLE

CROSS-REFERENCE TO RELATED APPLICATIONS

This application claims priority from European Patent Application No. 04 013 265.6, filed Jun. 4, 2004, the contents of which are herein incorporated by reference in their entirety to the fullest extent allowed by law.

BACKGROUND OF THE INVENTION

1. Field of the Invention

The present invention relates to an automatic central buffer coupling, especially of the "Tightlock/AAR" type of construction, for a multi-member rail vehicle.

2. Description of the Related Art

Coupling and decoupling of trains is a principle known from rail vehicle technology. When mechanical couplings are used to connect two adjacent car bodies, the coupling claw of the first car body is force-fit with the coupling claw of the other car body so as to transfer tractive force and momentum between the two car bodies mechanically coupled in this way.

Apart from the mechanical coupling of adjacent car bodies, electrical lines such as power and data cables are usually in simultaneous use, co-coupled by a plurality of contact terminals arranged on one electrical contact carrier. Moreover, a simultaneous co-coupling of compressed air lines should be provided. The simultaneous co-coupling of line couplings (electrical cables and compressed air lines) with the mechanical coupling operation requires, especially with respect to the contact terminals of the electrical connection, that the mechanical connection created between the two coupling heads of the adjacent car bodies be a rigid system or one which can be made rigid in order to ensure the necessary contact pressure and especially to avoid arcs occurring between the co-coupled contact terminals.

It is known, for example from DE 241 43 84 A1, that for the mechanical coupling of adjacent car bodies, the coupling head is to be designed such that the head has a plane front face disposed transversely to the longitudinal axis at the forward, front face end in the coupling plane which contacts the corresponding abutment surface of the mated coupling. A compressed air terminal is moreover hereto provided on or in said abutment surface for the co-coupling of a compressed air line.

However, the principle behind this arrangement, in which the rigid and play-free front faces of the respective car bodies meet does not readily allow the introduction of a central buffer coupling for certain types of construction, particularly in the case of claw couplings, for example those of the "AAR" (American Association of Railway) or "Tightlock" type, that there is in fact no front face or abutment surface disposed transversely to the longitudinal axis. Moreover, all the coupling heads of such constructional types basically still exhibit a certain amount of play during the coupling process such that longitudinal and transverse movements occur between the respective coupling heads which necessitate making the corresponding compensation in order to thereby enable efficient co-coupling of the electrical contact carrier and above all avoid the occurrence of material-damaging arcs at the contact terminals.

With the development of an automatic central buffer coupling based on the principle of a claw coupling, it is of fundamental importance to have an economical and flatly constructed solution for the design and arrangement of an electrical contact coupling and an air line coupling which are co-coupled together with the mechanical coupling of the coupling head. However, because of the high degree of play and the constant movement thereby seen in conjunction with such types of couplings, applicable solutions are only realizable given considerable technical or economical expenditure. Furthermore, in practice, such solutions can only be realized with difficulties or limitations since vertically tall-constructed central buffer couplings of the claw coupling type most notably lack the necessary installation spaces and clearances for installing an electrical contact coupling and/or the air line coupling.

Conversely, the example of AAR couplings are noted for their simple design, sturdy construction, high stability and low price. A further advantage is to be seen in that AAR couplings are universally applicable, in particular referring both to passenger as well as freight trains. These aspects have led to a worldwide interest in finding a solution to the problems cited above related to the automatic co-coupling of the electrical contact coupling and the air line coupling for these types of central buffer couplings which would be as readily feasible and economical as possible.

An electrical contact coupling for central buffer couplings, particularly for the example of claw couplings of the "AAR" type, is known from EP 1 102 696 A1, in which an electrical contact coupling is arranged underneath the mechanical coupling head in such a manner so as to be longitudinally displaceable in the longitudinal direction of the central buffer coupling. The electrical contact coupling is thereby disposed to be displaced rearward of the coupling plane in the uncoupled state. In this position, due to the design-contingent play of the coupling head, damage to the electrical contact carrier can be largely avoided when the coupling head moves along the coupling plane. While centering elements and interlocking points are provided on the electrical contact couplings for improving the contact pressure in accordance with the above-cited document, the solution indicated does not consider the problem of there still being increased play in the mechanical coupling. On the one hand, this leads to high stressing of the electrical contacts and, on the other, not being able to consistently guarantee a sound contact between two coupled electrical contact couplings.

Moreover, in the case of the coupling head in accordance with EP 1 102 696 A1, the pneumatic/hydraulic coupling of train members is effected by a fixed and elastic connection of the air coupling to the head. This necessitates the fixed air coupling terminals absorbing the mechanical play of the heads; however, this is only possible to a limited extent. Also to prove problematic with the proposed solution is the use of elastomeric blocks to secure one of the supporting units for the electrical contact coupling to the coupling head to enable a fixed but yet elastic connection to be made between the coupling head and the supporting unit. It turns out here that by using elastic elements for the connection, the play in the mechanical locking is transferred directly to the electrical contact coupling, which can lead to contact problems.

Starting from the subject matter of EP 1 102 698 A1 as a basis, the problem therefore facing the present invention is that electrical contact terminals have to date been subject to high stress during the co-coupling of electrical contact couplings in light of the simultaneous mechanical and electrical coupling operations in central buffer couplings of the AAR or Tightlock type and, because of the higher play seen in these types of couplings, a reduction in contact pressure and possible arcs can occur, and due to the higher play in the case of air couplings, compressed air losses, referred to as blowoff, can occur.

SUMMARY OF THE INVENTION

It is one object of the present invention to provide an automatic central buffer coupling which firstly improves the manipulation of the electrical contact coupling in such a way that the increased play of the mechanical coupling no longer leads to high stress and enables the making of a sound contact between two coupled electrical contact couplings. Furthermore, the mechanical play to the interlocking must be compensated in the air coupling integrated into the supporting unit In order to avoid drops in pressure.

Thus, the present invention relates to an automatic central buffer coupling, especially of the "Tightlock/AAR" type of construction, for a multi-member rail vehicle having a coupling head for the mechanical and force-fit coupling of a first car body with an adjacent second car body; a supporting unit arranged underneath said coupling head having at least one hydraulic and/or compressed air terminal for a hydraulic and/or compressed air line; an electrical contact carrier arranged underneath said supporting unit and guided so as to be longitudinally displaceable in the longitudinal direction of the central buffer coupling having electrical contact terminals for electrical connections; and an actuating device hydraulically or pneumatically controllable in the longitudinal displacement of said electrical contact carrier by means of the hydraulic and/or compressed airline, whereby said electrical contact carrier is in an uncoupled position rearward the coupling plane in uncoupled state, and whereby the electrical contact carrier is displaceable from the uncoupled rear position into a coupling-ready forward position in the coupling plane by means of the actuating device.

The automatic central buffer coupling of the present invention includes a release mechanism which is configured such that, subsequent the mechanical coupling of adjacent car bodies, it triggers a coupling mechanism for the coupling of at least one hydraulic and/or compressed air terminal of the first car body with the respective hydraulic and/or compressed air terminal arranged in mated fashion on the second car body in the coupling plane.

BRIEF DESCRIPTION OF THE DRAWINGS

The following will describe various embodiments of the inventive central buffer coupling in greater detail with reference being made to the following drawings, wherein.

DESCRIPTION OF THE INVENTION

Figure 1:
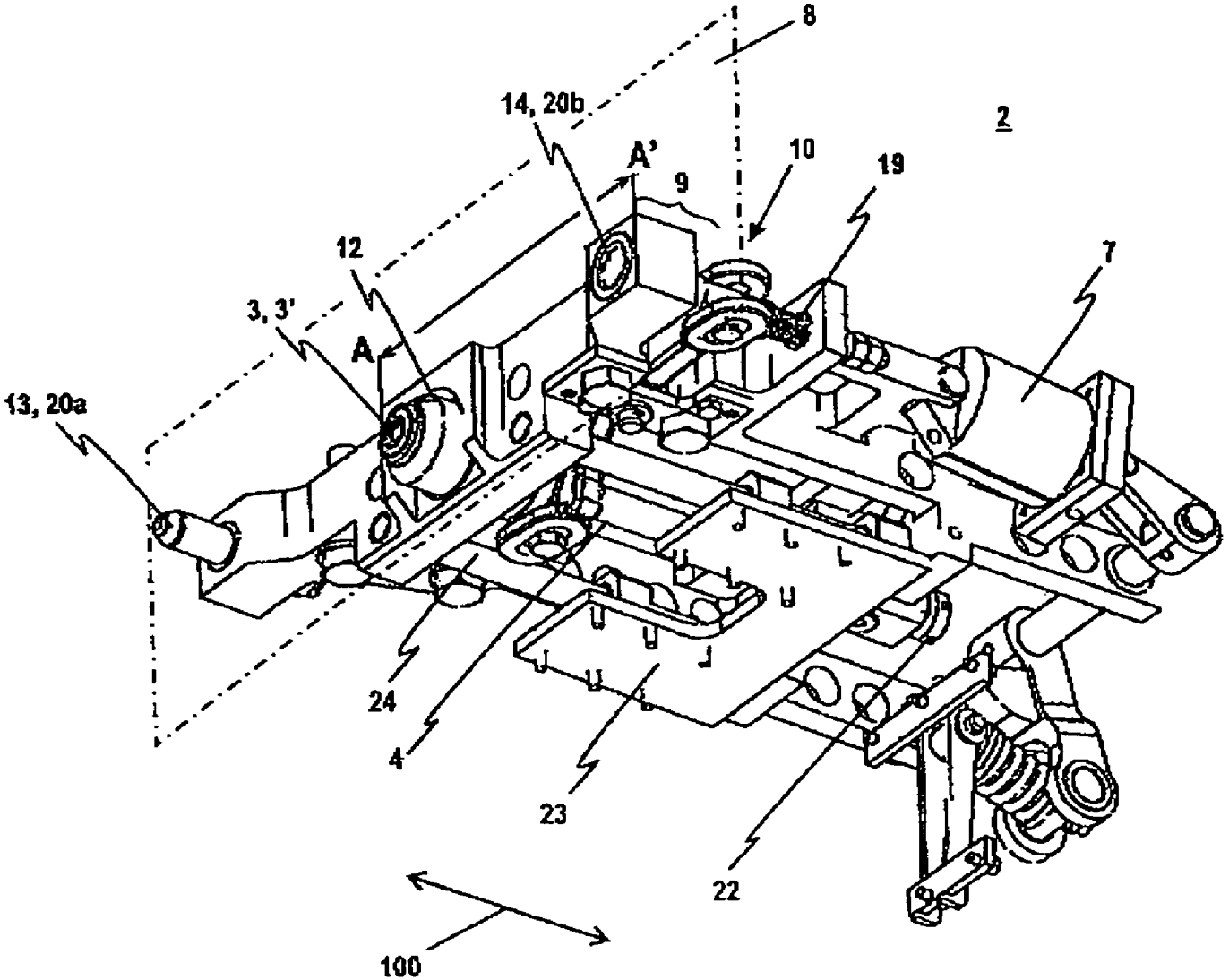
FIG. 1 is a perspective partial view of the supporting unit in one embodiment of the inventive central buffer coupling.

The present invention exhibits a full range of substantial advantages over the central buffer couplings known in rail vehicle technology and as described above. The release mechanism according to the present invention is advantageously realized in that the electrical contact coupling, the electrical contact carrier respectively, is essentially only shifted from the uncoupled rearward position into the forward coupling-ready position in the coupling plane when the mechanical coupling via the coupling head has been fully completed. This allows the contact of the electrical contact coupling to avoid being subjected to a constant movement ensuing from the higher play of the coupling head such that the known problems, particularly the reduced contact pressure and the incidence of arcs, can no longer occur. In accordance with the present invention, subsequent the mechanical coupling of adjacent car bodies, the release mechanism triggers the coupling mechanism to couple the hydraulic and/or compressed air terminal of the first car with the respective hydraulic and/or compressed air terminal arranged in mated fashion on the second car in the coupling plane. This co-coupling now also automatically enables the co-coupling of the associated hydraulic and compressed air line immediately following the mechanical coupling of the car bodies. As a consequence, the actuating device is hydraulically or pneumatically pressurized/actuated by the co-coupled hydraulic and/or compressed air line to longitudinally displace the electrical contact carrier, electrical contact coupling respectively. The result of which is then the electrical contact carrier can be shifted from the uncoupled rearward position by means of the operative actuating device into the forward coupling-ready position in the coupling plane, so that the co-coupling of the electrical contact carrier can also ensue. Thereby, because this sequence basically ensures that the co-coupling of the electrical contact terminals provided in or on the electrical contact carrier cannot transpire until after the mechanical coupling of the coupling head, an arc developing between the contact terminals due to the coupling heads moving relative one another can be excluded. This also ensures that the contact terminals will be co-coupled with sufficient contact pressure. The present invention accordingly makes it advantageously possible to significantly better the reliability of the electrical contact carrier co-coupling as well as increase the longevity of the contact terminals. Furthermore, the co coupling of the electrical contact coupling is not automatically initiated until after the mechanical coupling operation has been fully completed such that the coupling operation for the electrical contact coupling ensues automatically subsequent the completion of the mechanical coupling procedure.

It is for example provided that at least one hydraulic and/or compressed air terminal is arranged in a housing displaceable in a longitudinal direction of the central buffer coupling such that at least one hydraulic and/or compressed air terminal is behind the coupling head in the coupling plane in an uncoupled position in the uncoupled state, and can be displaced together with the housing via the coupling mechanism from the uncoupled rearward position into a forward coupling-ready position in the coupling plane for co-coupling of the hydraulic and/or compressed air terminal. It is thereby particularly preferential for at least one hydraulic and/or compressed air terminal to be arranged at the center of the supporting unit contact plane. This specific embodiment minimizes the effects which arise due to the play and/or the movement of the coupling head which thus ensures above all that the hydraulic and/or compressed air terminal basically remains in the retracted position from the coupling plane until the final state of the coupling heads is reached subsequent the mechanical and force-fit coupling of the two adjacent car bodies and thus movements of the coupling heads relative one another have ceased. During the mechanical uncoupling of the coupling head, the procedure is reversed in that shifting the housing with the therein provided hydraulic and/or compressed air terminal out of the coupling plane into the rearward position essentially occurs as a first step of the operation. Hence, the hydraulic and/or compressed air terminal is in principle always in the retracted position relative the coupling plane in advantageous fashion when the coupling head is undergoing the coupling and/or decoupling procedure. Providing a housing which is displaceable in the coupling direction and which accommodates the hydraulic and/or compressed air terminal affords added protection to the hydraulic and/or compressed air terminal. Such a housing can, of course, also be eschewed if the hydraulic and/or compressed air terminal is designed appropriately in and of itself.

It is particularly preferred for the release mechanism to comprise a stud/socket arrangement disposed in mated fashion relative a surface plane extending perpendicular the coupling plane, whereby disposed in the socket of the stud/socket arrangement, which receives the stud of the adjacent car body correspondingly arranged in mated fashion upon coupling with said adjacent car body, a setting pin displaceable in the coupling direction is provided, which is shifted out of the coupling plane upon the mechanical coupling of the adjacent car bodies by the ingressing stud of the adjacent car body, thereby activating the coupling mechanism. One advantage of this embodiment is that the stud/socket arrangement reduces the degree of freedom to the vertical and lateral movement of the entire coupling head and thus serves as a centering element. Another advantage is that the stud/socket arrangement initializes the mechanical actuating force to shift the setting pin disposed in the socket arrangement out of the coupling plane in the coupling direction. This displacement of the setting pin is what ultimately triggers the coupling mechanism to co-couple the hydraulic and/or compressed air terminal. It is, of course, also conceivable to provide another suitably configured device in place of the setting pin in the socket arrangement, such as for example a release catch or a tongue-shaped element.

In a particularly advantageous realization of the latter embodiment, the coupling mechanism of the hydraulic and/or compressed air terminal has a swivel arm disposed to rotate around a pivot pin which connects the setting pin with the housing of at least one hydraulic and/or compressed air terminal or itself connects by force with the hydraulic and/or compressed air terminal. Since the swivel arm connects the setting pin to the housing of the hydraulic and/or compressed air terminal or to the hydraulic and/or compressed air terminal itself, the stud of the stud/socket arrangement moving the setting pin out of the coupling plane in the longitudinal direction of the coupling results in the swivel arm turning around the horizontal pivot pin disposed to be pivotable and thus the housing of the hydraulic and/or compressed air terminal or the hydraulic and/or compressed air terminal itself shifts into the coupling plane in the longitudinal direction of the coupling. A pivoting mechanism is thus provided by means of which the shifting of the setting pin out of the coupling plane shifts the hydraulic and/or compressed air terminal into the coupling plane so as to co-couple the hydraulic and/or compressed air terminal and trigger the actuating device for the longitudinal displacement of the electrical contact carrier. Of course, other embodiments are likewise conceivable here, especially with respect to the pivoting mechanism.

In order to ensure that no shear forces but only tractive or thrust force will be transmitted from the setting pin to the hydraulic and/or compressed air terminal in the longitudinal direction of the coupling in the latter embodiment, it is advantageously provided that the swivel arm is in each case connected on the one hand with the setting pin and on the other with the housing of the hydraulic and/or compressed air terminal or with the hydraulic and/or compressed air terminal itself by a stud/slot arrangement, whereby said slot extends perpendicular to the longitudinal direction of the coupling and the stud is supported in the slot so as to be displaceable. Other embodiments are of course also conceivable here as well.

Another advantageous embodiment provides for the release mechanism to be additionally disposed with a reset mechanism which is configured such that subsequent the mechanical decoupling of both car bodies, the coupling mechanism resets to an unreleased state in which the hydraulic and/or compressed air terminal is uncoupled and thus the hydraulic and/or compressed air line is separated and deactivated. This is achieved in the embodiment application in that during the uncoupling procedure, the uncoupling cylinder of the mechanical coupling and the actuating cylinder of the electrical contact carrier are simultaneously subjected to hydraulics and/or compressed air, whereby the electrical and mechanical separation can take place at virtually the same time. After the separation is complete, the electrical contact carrier is in the retracted position behind the coupling plane, while the mechanical parts of the coupling are still together spatially. Not until the mechanical coupling moves apart does the separation of the hydraulic and/or compressed air line(s) follow. Of course, other sequence controls are also conceivable here, such as, for example, a delayed mechanical decoupling.

One embodiment of the present invention—although already known to some extent in rail vehicle technology—involves the coupling head having centering elements configured as a stud/socket arrangement for pre- and precise centering. Conceivable here would be for the centering pin for pre-centering the supporting unit to be arranged on the same side as the perpendicular longitudinal center plane of a centering socket disposed on the contact carrier for precise centering, and that the centering socket for pre-center is disposed on the contact carrier on the other side of the perpendicular longitudinal center plane, whereby the arrangement of the centering pin and the centering socket is for example designed such that during the centering operation, a respective centering pin and a respective centering socket are arranged on each side of the perpendicular center longitudinal plane. Advantageously, the centering elements can furthermore serve at least partly at the same time as a release mechanism for triggering the coupling mechanism. In so doing, a particularly compact configuration of the inventive central buffer coupling can above all be achieved, since the release mechanism assumes the function of releasing the coupling mechanism on the one hand and the function of centering the coupling head and/or the electrical contact carrier on the other.

In order to keep the at least one hydraulic and/or compressed air terminal in the coupling plane subsequent the co-coupling of same, and especially to prevent that the at least one hydraulic and/or compressed air terminal is not shifted out of the coupling plane subsequent the co-coupling by the operation of the coupling mechanism, a limiting device is provided in a particularly preferred realization of the inventive central buffer coupling which restricts the movement of the hydraulic and/or compressed air terminal to the coupling plane in the longitudinal direction of the coupling. On the other hand, subsequent the co-coupling of the at least one hydraulic and/or compressed air terminal, movement of the hydraulic and/or compressed air terminal out of the coupling plane in the longitudinal direction of the coupling is prevented by the constant hydraulic or pneumatic pressurizing or activated actuating device, it is thus possible to securely retain the hydraulic and/or compressed air terminal in the coupling plane following co-coupling. A stopper could, for example, well serve as a limiting device here, although other solutions are also possible.

Since a plurality of other signals must often be co-coupled with the electrical contact coupling, data bus/CCTV contacts can also be provided in the contact surface of the electrical contact carrier in addition to the usual contact terminals for power and/or signal transmission. Furthermore, the integrating of glass fiber connections in the contact surface of the electrical contact carrier would also be conceivable for optical signal transmission.

Figure 3:
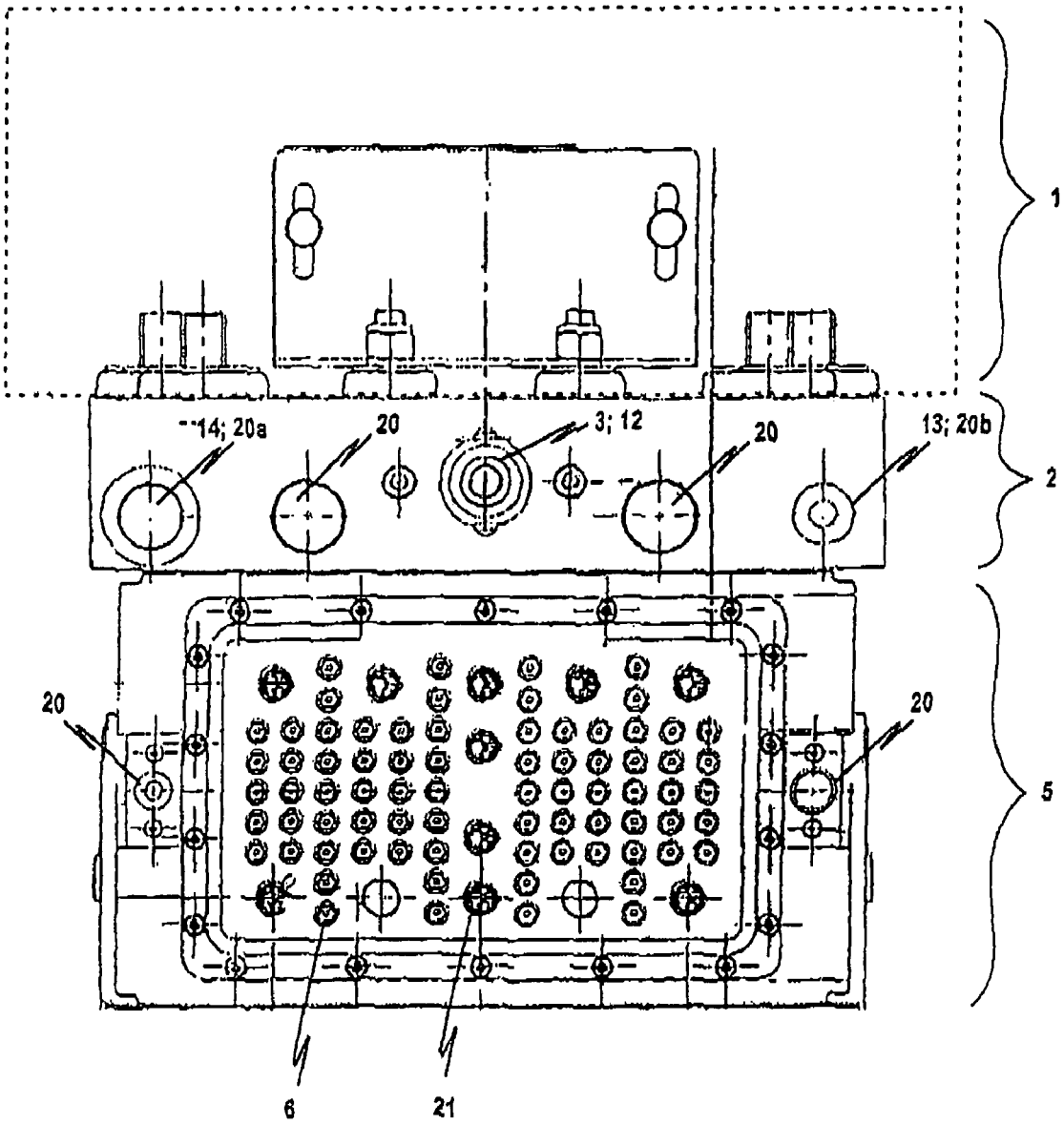
FIG. 3 is a frontal view of the supporting unit in the preferred embodiment together with the electrical contact coupling as a component of the inventive central buffer coupling.

FIG. 1 shows a perspective partial view of supporting unit 2 of a preferred embodiment of the inventive central buffer coupling, whereby supporting unit 2 is secured underneath a coupling head 1 of said central buffer coupling (shown in FIG. 3). The securing thereof is effected via a stud mounting such as screws, for example, which enable a fixed connection to be made between coupling head 1 and supporting unit 2. An electrical contact coupling 5 not shown in FIG. 1 is guided underneath the flatly-constructed supporting unit 2 so as to be displaceable in the longitudinal direction 100 of the coupling.

Figure 2:
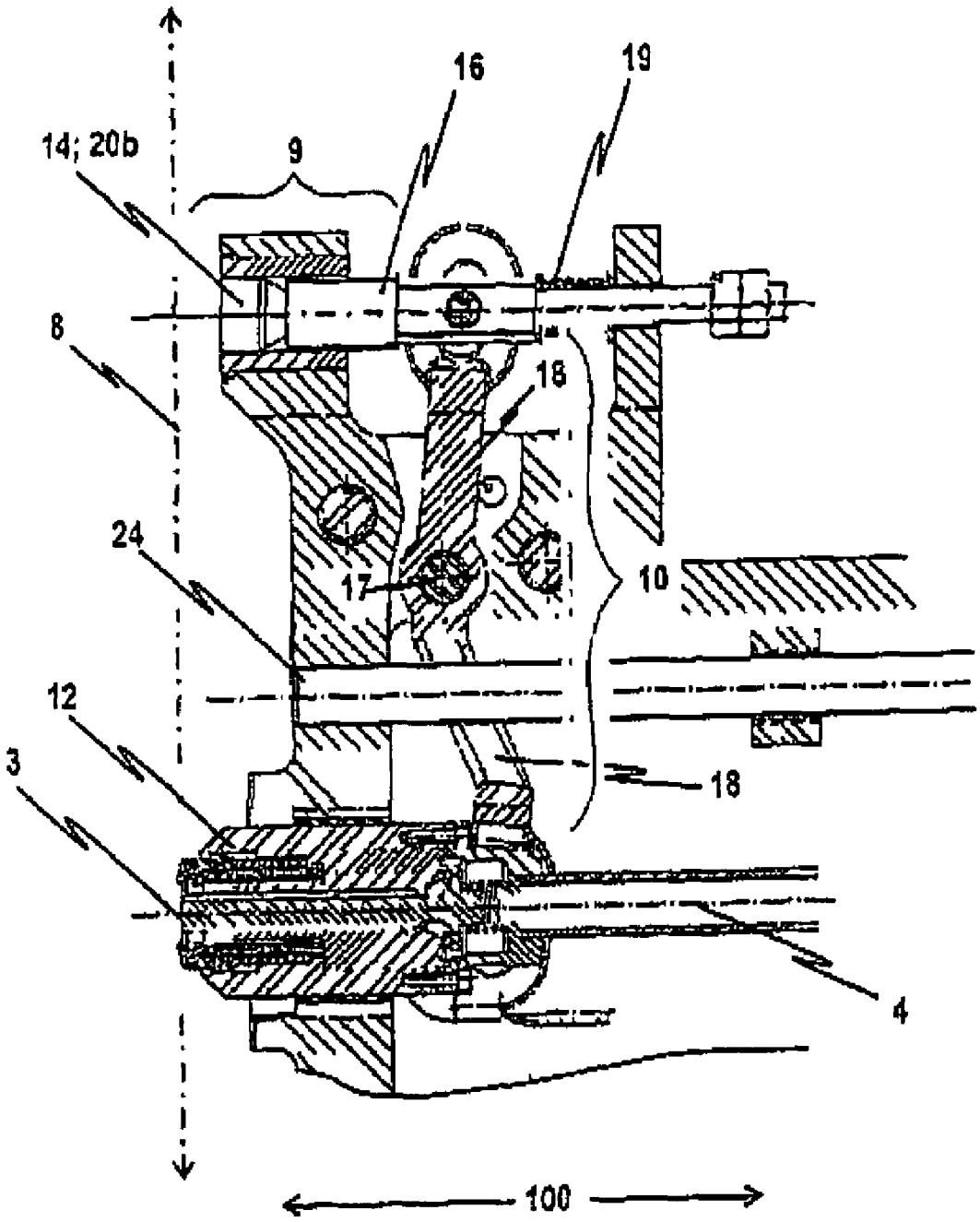
FIG. 2 is a sectional view of the supporting unit in the preferred embodiment taken along the A-A' line from FIG. 1.

FIG. 2 is a sectional view of supporting unit 2 taken along the A-A' line from FIG. 1 which depicts release mechanism 9 and coupling mechanism 10 for the coupling of a hydraulic and/or a compressed air terminal 3 in greater detail. To ensure the overview, FIGS. 1 and 2 only depict supporting unit 2 of the central buffer coupling together with the inventive structural members and components.

Electrical contact coupling 5 is supported to be longitudinally displaceable relative the central buffer coupling and supporting unit 2 by means of a guide carriage 23 which is arranged on two guide rods 24 oriented in the longitudinal direction 100 of the coupling and fixed side by side in supporting unit 2. Guide carriage 23 and thus the electrical contact coupling 5 secured thereto, is displaceable along guide rods 24 in the longitudinal direction 100 of the coupling by means of a preferably hydraulic or pneumatically pressurized or operated actuating device 7.

It is optionally conceivable to additionally provide a horizontally-swivable protective flap mounted on electrical contact coupling 5, operable via a lever mechanism, whereby the protective flap is pivoted in front of said electrical contact coupling 5 when guide carriage 23 is in the retracted position, and whereby the protective flap is pivoted downward in the advanced, coupling-ready position. It would be possible here for the pivoting of the protective flap to be continuous with the longitudinal movement of guidance carriage 23 by means of an appropriate mechanism.

A hydraulic and/or a compressed air terminal 3 of a hydraulic and a compressed air line 4 is arranged at the front end in the perpendicular longitudinal center plane of supporting unit 2, whereby said hydraulic and/or compressed air terminal 3 is positioned behind coupling plane 8 in an uncoupled state.

As depicted, hydraulic and/or compressed air terminal 3 is arranged in a central position in supporting unit 2 relative the transverse direction of the coupling. To protect terminal 3, same is disposed in a housing 12 displaceable in the longitudinal direction 100 of the coupling. A release mechanism is furthermore provided in supporting unit 2 which serves to release (not shown) coupling head 1 of coupling mechanism 10 following the mechanical co-coupling, which shifts hydraulic and/or compressed air terminal 3 into coupling plane 8 in the longitudinal direction 100 of the coupling.

It is thereby provided that said release mechanism 9 is disposed with a stud/socket arrangement 13, 14 arranged in mated fashion relative a surface plane extending perpendicular to coupling plane 8. During the coupling procedure, socket 14 receives the correspondingly mated stud (not shown) arranged on the adjacent car body. A setting pin 16 displaceable in the longitudinal direction 100 of the coupling is arranged in said socket 14 which, during the coupling operation, is shifted out of the coupling plane by the ingressing stud of the adjacent car body, thereby activating coupling mechanism 10.

By shifting setting pin 16, setting pin 16 activates coupling mechanism 10. As a consequence, an actuating device 7 arranged in supporting unit 2 is subjected to or actuated hydraulically or pneumatically via the co-coupled hydraulic and/or compressed air line 4 to longitudinally displace electrical contact carrier, electrical contact coupling 5 respectively. The result of the above is that electrical contact coupling 5 is then shifted from the uncoupled rearward position into the forward coupling-ready position in coupling plane 8 by means of activated actuating device 7 such that the co-coupling of electrical contact coupling 5 with the respectively adjacent car body can then follow.

Coupling mechanism 10 thereby exhibits a swivel arm 18 mounted so as to be rotatable around pivot pin 17 which force-fit connects setting pin 16 with housing 12 of the hydraulic and/or compressed air terminal 3. Connecting setting pin 16 to housing 12 by means of swivel arm 18 has the result that when setting pin 16 is moved out of coupling plane 8 in the longitudinal direction 100 of the coupling, swivel arm 18 pivots around pivot pin 17 disposed so as to be horizontally pivotable and housing 12 is then shifted into coupling plane 8 in the longitudinal direction 100 of the coupling.

Release mechanism 9 is further disposed with a reset device 19. Configured here as a spring element, said reset device 19 resets coupling mechanism 10 to an unreleased state following the mechanical decoupling of both car bodies in which hydraulic and/or compressed air terminal 3 is decoupled and thus the hydraulic and/or compressed air lines 4 are separated and deactivated.

In order to prevent the at least one hydraulic and compressed air terminal 3 from not being shifted out of coupling plane 8 by the operation of coupling mechanism 10 subsequent the co-coupling, a limiting device 22 is provided which restricts the movement of hydraulic and/or compressed air terminal 3 in the longitudinal direction 100 of the coupling to coupling plane 8.

For the sake of completeness, FIG. 3 shows a frontal view of supporting unit 2 together with electrical contact coupling 5 as a structural component of the inventive central buffer coupling.

Supporting unit 2 is configured as a flat construction and has a smaller vertical measurement than electrical contact coupling 5. The height of supporting unit 2 is preferably only about half the height of electrical contact coupling 5. In order to realize the flattest and most compact construction and design possible for an electrical contact coupling 5 and a hydraulic and/or air line coupling 3, particularly for mounting to a central buffer coupling of the previously specified "AAR" or "Tightlock" type, the hydraulic and/or compressed air terminal 3 is integrated into a housing 12 in supporting unit 2. At the same time, supporting unit 2 compactly accomodates actuating device 7 configured for example as actuating cylinders 7 Arranged horizontally side by side.

Centering elements 20 for precentering supporting unit 2 are arranged on said supporting unit 2. Additional centering elements 20 for precise centering are arranged on electrical contact coupling 5. Centering elements 20 are formed by respective centering pins 20*a* and centering sockets 20*b* whereby the respective centering pin 20*a* engages in the respective centering socket 20*b* of the mated coupling during the coupling operation; i.e., upon each longitudinal movement or longitudinal displacement of supporting unit 2 and electrical contact coupling 5. The arrangement of centering elements 20 is expedient such that a centering socket 20*b* on electrical contact carrier is associated with the centering pin 20*a* for re-centering on supporting unit 2 on the same side with respect to the perpendicular center longitudinal plane, and that centering pin 20*a* for precise centering on electrical contact coupling 5 is associated with centering socket 20*b* for pre-centering supporting unit 2 on the other side of the perpendicular longitudinal center plane. Center pin 20*a* and centering socket 20*b* are thus arranged one underneath the other on each side of the perpendicular longitudinal center plane.

Electrical contact terminals 6 are arranged in the contact surface in the front part of electrical contact coupling 5 according to a specific pattern, largely in one plane and transversely to the longitudinal direction 100 of the coupling. It is hereby to be noted that in addition to being equipped with conventional stud/socket contacts for the co-coupling of electrical signals, the contact surface may also be provided with special data bus and CCTV contacts (multimedia and television).

What is claimed is:

1. An automatic central buffer coupling for a multi rail vehicle, comprising:

a coupling head for a mechanical and force-fit coupling of a first car body with an adjacent second car body, said coupling head having centering elements designed as a pin/socket arrangement for pre-centering and precision centering;

a supporting unit arranged underneath said coupling head having at least one of a hydraulic and compressed air terminal for at least one of a hydraulic and compressed air line;

an electrical contact carrier arranged underneath said supporting unit and guided so as to be displaceable in a longitudinal direction of said central buffer coupling, said electrical contact carrier having contact terminals for electrical connections; and an actuating device for a displacement of the electrical contact carrier in the longitudinal direction, said actuating device being one of a hydraulically controllable actuating device and a pneumatically controllable actuating device, and further being controllable by means of at least one of the hydraulic and compressed air line, wherein the electrical contact carrier is in an uncoupled position behind a coupling plane of the central buffer coupling in an uncoupled state;

wherein the electrical contact carrier is displaceable from an uncoupled rearward position into a coupled forward position in the coupling plane by means of the actuating device; and wherein the centering elements serve simultaneously as a trigger device for triggering a coupling mechanism for coupling of at least one of the hydraulic and the compressed air line upon mechanical coupling of the adjacent first and second car bodies, wherein an adjusting pin, which is displaceable in the longitudinal direction of said central buffer coupling, is accommodated in the socket of the pin/socket arrangement, which socket, upon coupling to the adjacent car body, receives the pin of the adjacent car body arranged in a correspondingly complementary manner, said adjusting pin being displaced away from the coupling plane upon the mechanical coupling of the adjacent first and second car bodies by a penetrating pin of the adjacent car body and thereby triggering the coupling mechanism.

2. The central buffer coupling in accordance with claim 1, wherein at least one of the hydraulic and compressed air terminal is arranged in a housing displaceable in a longitudinal direction of the central buffer coupling such that at least one of the hydraulic and compressed air terminal is in an uncoupled position behind the coupling plane, when the central buffer coupling is in the uncoupled state, and can be displaced together with the housing via the coupling mechanism from an uncoupled rearward position into a forward coupled position in the coupling plane.

3. The central buffer coupling in accordance with claim 1, wherein said centering elements comprise:

a stud/socket arrangement disposed in a mated fashion relative to a surface plane extending perpendicular to the coupling plane; and a setting pin displaceable in the longitudinal direction of the coupling, and disposed in a socket of the stud/socket arrangement, which receives the stud of the adjacent car body correspondingly arranged in mated fashion upon coupling with said adjacent car body, said selling pin which is shifted out of the coupling plane upon the mechanical coupling of adjacent car bodies by an ingressing stud of the adjacent car body and thereby activating the coupling mechanism.

4. The central buffer coupling in accordance with claim 3, wherein said coupling mechanism comprises a swivel arm rotatably supported around a pivot pin which forcibly connects the setting pin with the housing of the at least one of the hydraulic and compressed air terminal.

5. The central buffer coupling in accordance with claim 4, wherein the swivel arm is connected in such a manner to the setting pin on one hand and with the housing on another, that only a tractive force and momentum is transferred from the setting pin to the housing in the longitudinal direction of the coupling.

6. The central buffer coupling in accordance with claim 1, wherein said release mechanism further comprises a reset device which is configured such that subsequent the mechanical decoupling of both car bodies, the coupling mechanism resets to an unreleased state in which at least one of the hydraulic and compressed air terminals is uncoupled and at least one of the hydraulic and compressed air line is separated.

7. The central buffer coupling in accordance with claim 1, wherein subsequent co-coupling of at least one of the hydraulic and compressed air terminals, same is held in the coupling plane by a limiting device.

* * * * *